United States Patent [19]

Riche

[11] Patent Number: 4,773,343

[45] Date of Patent: Sep. 27, 1988

[54] BUTTON ATTACHMENT METHOD

[76] Inventor: Frank Riche, 295 Calhoun Ave., Bronx, N.Y. 10465

[21] Appl. No.: 118,400

[22] Filed: Nov. 6, 1987

[51] Int. Cl.[4] ..... D01B 3/12

[52] U.S. Cl. ..... 112/265.1; 2/265; 223/102; 24/90 B

[58] Field of Search ..... 112/265.1; 2/265; 223/102; 24/90 B: 90 R, 90 TA, 143 B

[56] References Cited

U.S. PATENT DOCUMENTS

| | | | |
|---|---|---|---|
| 380,773 | 4/1888 | Smith, Jr. | 223/102 |
| 903,674 | 11/1908 | Cohn | 24/90 R |
| 1,225,814 | 5/1917 | Holste | 24/90 B |
| 1,402,341 | 1/1922 | Chaffee | 24/143 B |
| 1,674,544 | 6/1928 | Hertelendy | 223/102 |
| 2,605,943 | 8/1952 | Hoefle | 223/102 |
| 3,795,948 | 3/1974 | Kapitan | 24/90 TA |
| 4,333,182 | 6/1982 | Seibt | 2/265 |

*Primary Examiner*—Louis K. Rimrodt
*Assistant Examiner*—J. L. Olds
*Attorney, Agent, or Firm*—Gottlieb, Rackman & Reisman

[57] ABSTRACT

A method for attaching a button to a piece of fabric or clothing is provided. The method includes the step of pre-threading a two or four-holed button with a piece of tying thread connected at both ends to a pair of needles and then inserting the needles through the fabric or clothing in order to attach the button. Once the needles are pulled through the fabric, a double knot is tied close to the fabric on the needle end side and the needles are then discarded by cutting the thread at a point adjacent to the fabric. The method enables the offsetting of the button from the fabric or garment and also avoids the complications of having to thread the button holes and the fabric sequentially as part of the attachment process.

14 Claims, 3 Drawing Sheets

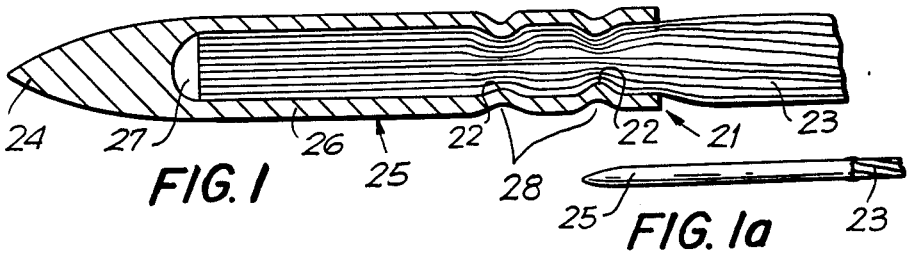
FIG. 1
FIG. 1a
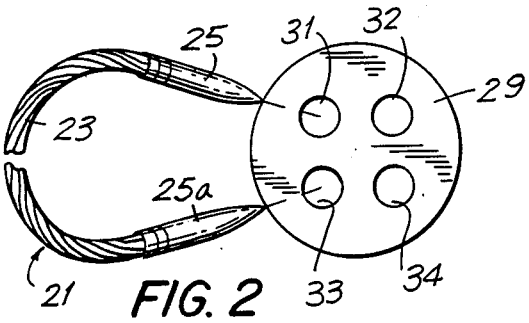
FIG. 2
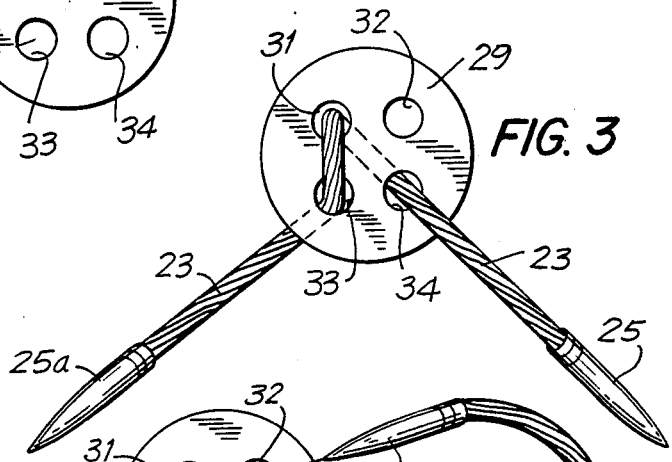
FIG. 3
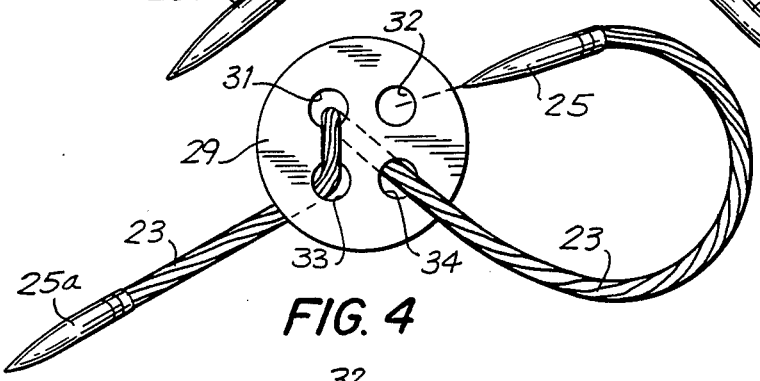
FIG. 4
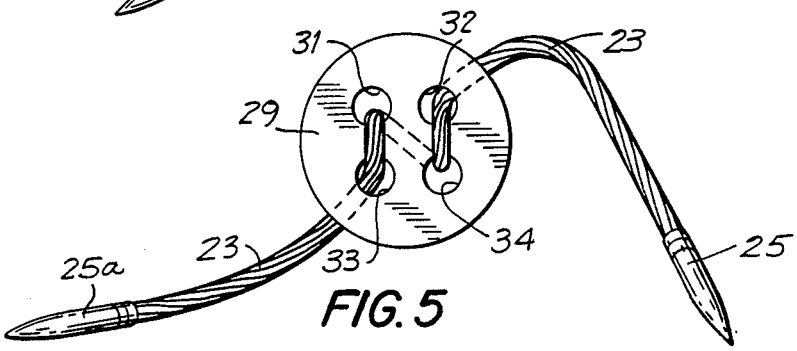
FIG. 5

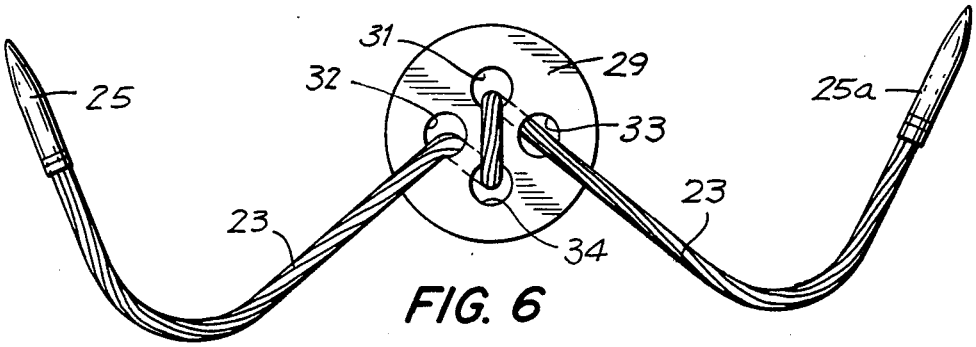
FIG. 6
FIG. 7
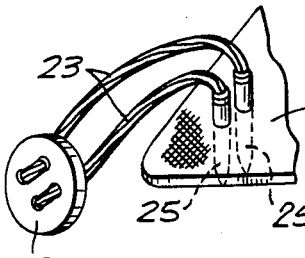
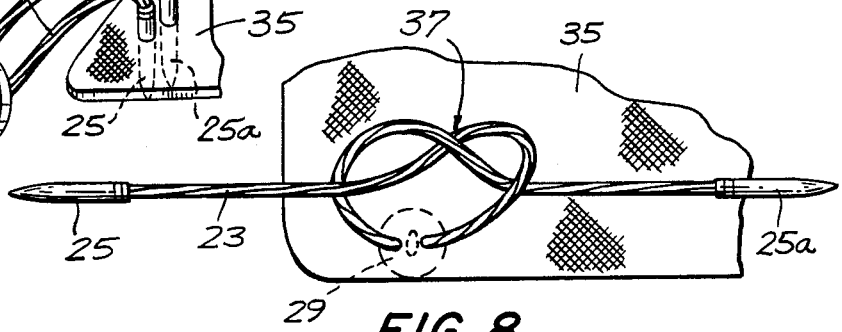
FIG. 8
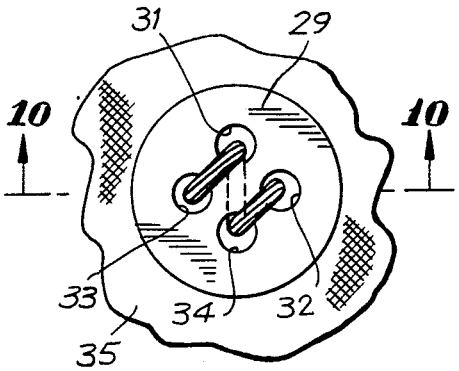
FIG. 9
FIG. 10
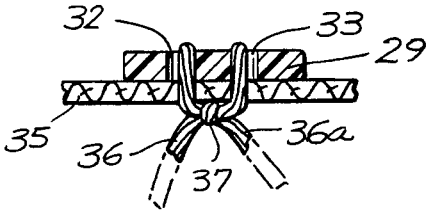

FIG. 12
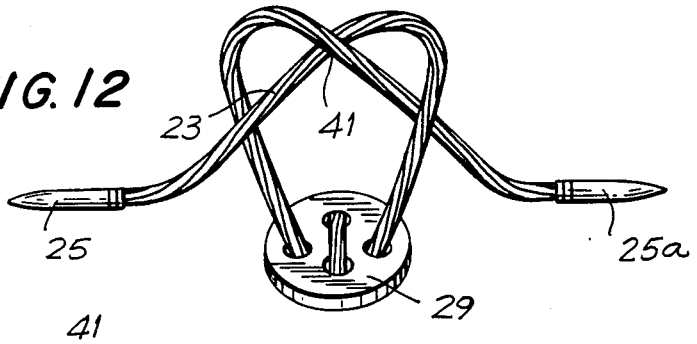
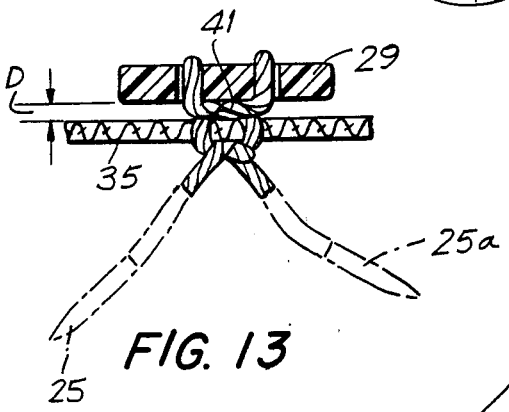
FIG. 13
FIG. 11
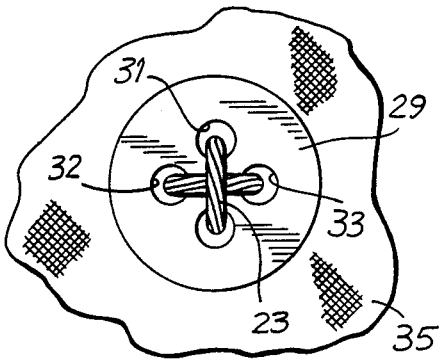
FIG. 15
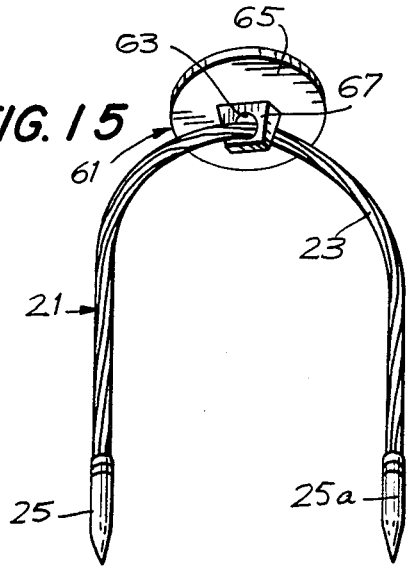
FIG. 14
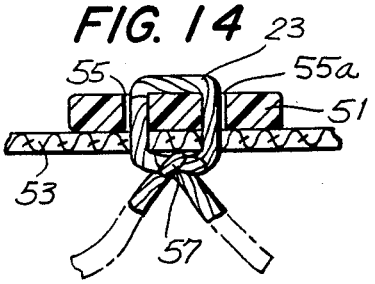

BUTTON ATTACHMENT METHOD

BACKGROUND OF THE INVENTION

This invention is directed to a method for attaching a button to a garment or fabric, and more particularly, to pre-threading a two or four-holed button with a piece of tying thread connected at both ends to a pair of needles and then inserting the needles through the fabric or garment in order to attach the button.

Normally, if a button from an article of clothing becomes loose or is detached, it is necessary to reattach the button to the clothing by sewing the button thereon in a conventional manner. Nevertheless, there are a number of prior art methods or assemblies which enable attachment of the button without having to manually sew the button onto the article of clothing.

In one device, a button fastener having a needle tip extending therefrom and provided with an attaching element at the end of the needle may be used. In operation, the tip of the needle is inserted through a hole in the button and then through the fabric in order to drive a plastic fastener through both the button and the fabric, thereby coupling the button to the fabric.

Another available device is in the nature of a "button pin", similar to a tie tack. The button to be attached is pre-formed with a rearwardly extending pin portion which can engage a female member, also purchased as part of the assembly. The front of the button is provided with simulated "threads" to give the appearance of a sewn-on button. In use, the pin portion of the button is inserted through the article of clothing and then received in the female member on the opposite side of the fabric in order to attach the button securely.

Still another device for attaching a button to a fabric or garment is a mechanism which includes a head and extending filament portion. In use, the filament is threaded first through one hole of the button and then through the second button hole in order that the head abuts against the button. The filament portion is then tied off and the excess filament can be cut, leaving the button securely attached to the fabric.

Although these prior art button-attaching methods as well as others, are somewhat satisfactory, they also include a number of disadvantages. Many prior art methods use simulated plastic, rather than real thread, in carrying out the attachment process. Additionally, some prior art methods require the use of bulky tools having sharp points, which create the risk of injury to the individual applying these methods.

Accordingly, it is desirable to provide a method for attaching a button to a fabric or garment that overcomes the disadvantages that the above-mentioned methods have, and which is suitable for use with either a two or four-holed button.

SUMMARY OF THE INVENTION

Generally speaking, in accordance with the invention, a method for attaching a button to a piece of fabric or an article of clothing utilizing a piece of tying thread connected at one end to a needle and at the other end to a second needle is provided. The method includes the step of pre-threading a two or four-holed button with the piece of tying thread and then, after threading, inserting the needles through the fabric or clothing to which the button is to be attached. After pulling each needle through the fabric in order to affix the button firmly thereto, a double overhand knot is tied close to the fabric on the side to which the needles extend, and the needles are then discarded after cutting the thread at points therealong adjacent to the fabric.

The method in accordance with the invention enables offsetting of the button from the garment, which is not possible with most prior art methods, and also avoids the complications of having to thread the button holes of the button and the fabric sequentially as part of the attachment process. Furthermore, only two puncture holes are made in the fabric during the sewing operation, whereas in conventional methods for sewing a four-holed button on a garment, at least four puncture holes are required in the fabric.

Accordingly, it is an object of this invention to provide a method for attaching a two or four-holed button to a piece of fabric or garment.

It is a further object of the invention to provide a method for attaching a button to a garment which enables offsetting of the button from the garment.

Still another object of the invention is to provide a button attaching method which avoids the complications of having to thread the button holes and the fabric sequentially.

Still a further object of the invention is to provide a method for attaching a button to a fabric where only two puncture holes are made in the fabric during the sewing operation.

Yet another object of the invention is to provide a button attachment method that does not require the use of bulky tools having sharp points.

Yet a further object of the invention is to provide a button attaching method suitable for use with a variety of thread thicknesses and colors in order to match the fabric type and color of the garment to which the button is being attached.

Still other objects and advantages of the invention will, in part, be obvious, and will, in part, be apparent from the following description.

The invention accordingly comprises the several steps and the relation of one or more of such steps with respect to each of the others, and the articles possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 1 is a cross-sectional view of a needle attached by physical crimping to the ends of a piece of tying thread in accordance with the invention;

FIG. 1*a* is a side elevational view of a needle attached by physical bonding to the end of a piece of tying thread in accordance with the invention;

FIG. 2 is a top elevational view of a four-holed button prior to threading in a manner in accordance with the invention;

FIG. 3 is a top elevational view of the four-holed button shown in FIG. 2 during initial threading with a piece of tying thread in a manner in accordance with the invention;

FIG. 4 is a top elevational view similar to FIG. 3, but illustrating the final step of threading the button with a piece of tying thread in a manner in accordance with the invention;

FIG. 5 is a top elevational view of a the four-holed button shown in FIGS. 2–4 threaded with a piece of tying thread in a manner in accordance with the invention;

FIG. 6 is a bottom elevational view of the four-holed button in FIG. 5;

FIG. 7 is a perspective view of the four-holed button of FIGS. 5 and 6 during attachment thereof to a fabric in a manner in accordance with the invention;

FIG. 8 is a bottom elevational view of the fabric shown in FIG. 7 during attachment of the four-holed button thereto in a manner in accordance with the invention;

FIG. 9 is a top elevational view of the four-holed button of FIGS. 5 and 6 attached to the fabric shown in FIGS. 7 and 8 in a manner in accordance with the invention;

FIG. 10 is a cross-sectional view taken along line 10—10 of FIG. 9;

FIG. 11 is a top elevational view similar to FIG. 9, but showing a second method of threading a four-holed button for attachment to a piece of fabric;

FIG. 12 is a perspective view of the underside of a four-holed button threaded to enable offsetting thereof from a garment during attachment thereto in a manner in accordance with the invention;

FIG. 13 is a cross-sectional view of the four-holed button shown in FIG. 12 in which it is offsettingly attached to a garment in a manner in accordance with the invention;

FIG. 14 is a cross-sectional view of a two-holed button attached to a garment in a manner in accordance with the invention; and FIG. 15 is a perspective view of a shank button threaded with a piece of tying thread prior to attachment to a garment in a manner in accordance with the invention.

DETAILED DESCRIPTION OF THE PREFERRED EMBODIMENT

Referring initially to FIGS. 1 and 2, thread assemblies for use as part of the method in accordance with the invention are shown. FIG. 1 illustrates a portion of a thread assembly 21, which includes a piece of tying thread 23 comprising a bundle of unwoven threads and needle 25 connected at one end thereof. Needle 25 includes a forward tip 24 and a longitudinally extending substantially annular rear wall 26 defining a tubular opening 27 for receiving tying thread 23. After inserting the end of thread 23 into opening 27, a pair of radial segments 28 of wall 26 are inwardly crimped in order to form a corresponding pair of annular ribs 22, which pinch against thread 23. Consequently, the end of thread 23 is permanently retained within wall 26 of needle 25. This engaging action is otherwise referred to as physical crimping, and enables the physical attachment of the end of tying thread 23 to needle 25.

Alternatively, as FIG. 1*a* illustrates, needle 25 may be chemically bonded to the end of tying thread 23 in order to manufacture a thread assembly suitable for carrying out the method in accordance with the invention. Particularly, rear portion of needle 25 is first positioned in partial overlapping relationship with one end of tying thread 23. A suitable chemical bonding reaction at an elevated temperature which is known in the art is then applied to the overlapping region in order to chemically bond needle 25 to the end of tying thread 23, as shown in FIG. 1*a*.

Turning now to FIGS. 2–6, the method for threading tying thread assembly 21 to a four-holed button 29 in a manner in accordance with the invention is described. Button 29 includes four button holes 31, 32, 33 and 34 formed symmetrically therethrough. Thread assembly 21 includes tying thread 23 and a pair of needles 25 and 25*a* attached at either end by physical crimping, as described hereinabove. In order to thread button 29 with thread assembly 21, needle 25 is inserted through hole 31 and needle 25*a* is inserted through hole 33. As a result, needles 25 and 25*a* are now positioned along the underside of button 29. Then, needle 25 is inserted through hole 34 positioned opposite hole 31, as FIG. 3 illustrates, in order to return needle 25 to the top side of button 29. Finally, needle 25 is inserted through hole 32, positioned opposite hole 33, as shown in FIGS. 4 and 5, in order that both needles 25 and 25*a* extend from the underside of button 29 at opposite ends thereof.

If the method of threading thread assembly 21 through button 29 is carried out appropriately, then button 29 should appear from the underside as is shown in FIG. 6, with the ends of thread 23 extending from holes 32 and 33 respectively. Since holes 32 and 33 are positioned opposite each other, threading in accordance with the invention insures proper balance of button 29 when attached to a fabric or a garment.

Turning now to FIGS. 7–10, the attachment of four-holed button 29 to a fabric 35 in a manner in accordance with the invention is shown. Needles 25 and 25*a* extending from the ends of tying thread 23 are inserted through fabric 35, as shown in FIG. 7. After pulling needles 25 and 25*a* through fabric 35 in order that button 29 is flush against fabric 35, a double knot 37 is tied close to fabric 35 on the underside thereof. Needles 25 and 25*a* are then discarded by cutting the ends of thread 23 at points 36 and 36*a* adjacent to fabric 35. Consequently, four-holed button 29 is permanently affixed to fabric 35 and is ready for use in normal buttoning operations.

Turning now to FIG. 11, an alternative method for threading four-holed button 29 for attachment to a fabric or garment is now described. As is shown, threading occurs in a manner which achieves a cross-configuration of thread 23 along the top portion of button 29. Particularly, one end of thread 23 (for example) is inserted through hole 32 and the other end is inserted through hole 33. The second end is then pulled up through hole 31 and inserted down through hole 34. Since the ends of thread 23 now extend from the underside of button 29, thread 23 may be attached to fabric 35 in a manner similar to that shown in FIGS. 7–10, as described above.

FIGS. 12 and 13 describe the offsetting of button 29 from fabric 35 in a manner in accordance with the inventive method. Four-holed button 29 is first threaded in the manner illustrated in FIGS. 2–6, and described hereinabove. Then, prior to attachment of button 29 to fabric 35, the ends of thread 23 are tied in the manner shown in FIG. 12, in order to make at least one overhand knot 41. Once overhand knot 41 is completed, needles 25 and 25*a* are inserted through fabric 35 in the manner described in FIGS. 7–10, in order to affix button 29 to fabric 35. As FIG. 13 illustrates, four-holed button 29 is now positioned in offset relationship with respect to fabric 35, separated by dimension "D" therefrom, which is especially suitable for coats and other heavy garments that require greater flexibility of button 29 during buttoning operations.

Turning now to FIG. 14, the method for attaching a two-holed button 51 to a fabric 53 in a manner in accordance with the invention is described. Initially, the needles (not shown) connected to the ends of thread 23 are threaded through two-holed button 51 by inserting the needles through holes 55 and 55*a* respectively. Then, the needles are inserted through fabric 53 in order to position two-holed button 51 flush against fabric 53 (optionally, prior to needle insertion through fabric 53, offsetting of button 51 from fabric 53 may be achieved, as described with respect to the four-holed button in FIGS. 12–13). Thereafter, as shown in FIG. 14, and similar to the attachment of a four-holed button as described above, a double knot 57 is tied in thread 23 close to fabric 53 on the bottom end thereof. The needles attached to the ends of thread 23 are then discarded by cutting the ends of thread 23 at points adjacent to fabric 53, similar to what was done with respect to the four-holed button.

Alternatively, and in accordance with the described invention, a shank button 61, as shown in FIG. 15, may be used for attachment to a fabric or garment. Shank button 61 includes a button member 65 and a spacing tab 67 extending from the underside of button member 65 and formed with a button hole 63. Shank button 61 is first threaded by inserting one of needles 25 and 25*a* of thread assembly 21 through shank button hole 63. Once threading is completed, needles 25 and 25*a* are then inserted through the fabric to which shank button 61 is to be attached in a manner similar to that described with respect to the two and four-holed buttons. As a result, button member 65 of shank button 61 is offset from the fabric by spacing tab 67, which sits flush against the fabric.

Unlike conventional button attaching methods, the method in accordance with the invention requires only two puncture holes to be made in the fabric during the sewing operation, thereby reducing the damage to the fabric or clothing to which the button is to be attached.

Moreover, the thread assembly which is used as part of the inventive method may be manufactured with a variety of thread thicknesses and colors in order to match the fabric type and color of the garment to which the button is attached.

Furthermore, the method of the invention enables offsetting of the button from the fabric or garment without the need for a specialized button.

It will thus be seen that the objects set forth above, among those made apparent from the preceding description, are efficiently attained, and since certain changes may be made in the above method without departing from the spirit and scope of the invention, it is intended that all matter contained in the above description and shown in the accompanying drawings is merely illustrative, and should not be viewed in a limiting since.

It is also to be understood that the following claims are intended to cover all of the generic and specific features of the invention herein described and all statements of the scope of the invention which, as a matter of language, might be said to fall therebetween.

What is claimed is:

1. A method for attaching a button having a plurality of holes to a garment or a fabric utilizing a tying thread connected at both ends to a pair of needles, the method comprising:

threading said holes of said button with said tying thread;

inserting each of said needles through said fabric after said threading step;

tying said ends of said thread at a location proximate to said fabric on the side of said fabric opposite said button; and disconnecting said needles from said thread.

2. The method of claim 1, further including the step of tying at least one knot in said thread in proximity to said button after said threading step and prior to said inserting step.

3. The method of claim 1, wherein said threading step comprises threading a four-holed button.

4. The method of claim 1, wherein said disconnecting step comprises severing said thread beyond said proximate location and discarding said severed thread and said needles.

5. A method for attaching a button having a plurality of holes to a garment or fabric utilizing a tying thread, the method comprising:

connecting said tying thread at both ends thereof to a pair of needles;

threading said holes of said button with said tying thread;

inserting each of said needles through said fabric after said threading step;

tying the ends of said thread at a location proximite to said fabric on the side of said fabric opposite said button; and disconnecting said needles from said thread.

6. The method of claim 5, further including the step of tying at least one knot in said thread in proximity to said button after said threading step and prior to said inserting step.

7. The method of claim 5, wherein said connecting step comprises physically crimping said needles to said tying thread.

8. The method of claim 5, wherein said connecting step comprises chemical bonding said needles to said tying thread.

9. The method of claim 5, wherein said inserting step includes pulling the ends of said thread through said fabric so that said button is positioned against said fabric.

10. The method of claim 5, wherein said disconnecting step comprises severing said thread beyond said proximite location and discarding said severed thread and said needles.

11. A method for attaching a button having four holes to a garment or fabric utilizing a tying thread connected at both ends to a pair of needles, the method comprising:

threading said button with said tying thread;

inserting said needles through said fabric after said threading step to position said button along one side of said fabric;

tying said ends of said thread at a location proximite to said fabric on the side of said fabric opposite said button; and disconnecting said needles from said thread.

12. The method of claim 11, further including the step of tying at least one knot in said thread in proximity to said button after said threading step and prior to said inserting step.

13. The method of claim 11, wherein said threading step comprises pulling said needles through said holes of said button.

14. The method of claim 13, wherein said needle pulling step comprises exiting said first needle through a first hole, and exiting said second needle through a second opposite hole, said needles being ready for said fabric inserting step.

* * * * *